US008365823B2

(12) United States Patent
Dreher, Jr. et al.

(10) Patent No.: US 8,365,823 B2
(45) **Date of Patent: *Feb. 5, 2013**

(54) IN-SITU UPGRADING OF HEAVY CRUDE OIL IN A PRODUCTION WELL USING RADIO FREQUENCY OR MICROWAVE RADIATION AND A CATALYST

(75) Inventors: W. Reid Dreher, Jr., Katy, TX (US); Thomas J. Wheeler, Houston, TX (US); Dwijen K. Banerjee, Owasso, OK (US)

(73) Assignee: ConocoPhillips Company, Houston, TX (US)

( * ) Notice: Subject to any disclaimer, the term of this patent is extended or adjusted under 35 U.S.C. 154(b) by 306 days.

This patent is subject to a terminal disclaimer.

(21) Appl. No.: 12/781,912

(22) Filed: May 18, 2010

(65) Prior Publication Data

US 2010/0294489 A1 Nov. 25, 2010

Related U.S. Application Data

(60) Provisional application No. 61/180,057, filed on May 20, 2009.

(51) Int. Cl.
*E21B 47/01* (2006.01)

(52) U.S. Cl. ..... 166/272.1; 166/272.7; 166/302

(58) Field of Classification Search ..... 166/272.1, 166/272.2, 272.7, 302
See application file for complete search history.

(56) References Cited

U.S. PATENT DOCUMENTS

| | | | | |
|---|---|---|---|---|
| 4,144,935 | A | 3/1979 | Bridges et al. | |
| 4,193,448 | A | 3/1980 | Jeambey | |
| 4,620,593 | A | 11/1986 | Haagensen | |
| 4,638,863 | A | 1/1987 | Wilson | |
| 4,819,723 | A | 4/1989 | Whitfill et al. | |
| 5,076,727 | A | 12/1991 | Johnson et al. | |
| 5,082,054 | A | 1/1992 | Kiamanesh | |
| 5,299,887 | A | 4/1994 | Ensley | |
| 6,012,520 | A | 1/2000 | Yu et al. | |
| 6,086,830 | A | 7/2000 | Kartchner | |
| 6,284,105 | B1 | 9/2001 | Eliasson et al. | |
| 7,312,428 | B2 | 12/2007 | Kinzer | |
| 7,331,385 | B2 | 2/2008 | Symington et al. | |
| 8,049,056 | B2 * | 11/2011 | Ball | 588/320 |
| 2007/0246994 | A1 | 10/2007 | Kaminsky | |
| 2007/0289736 | A1 | 12/2007 | Kearl | |
| 2008/0073079 | A1 | 3/2008 | Tranquilla | |
| 2008/0087428 | A1 | 4/2008 | Symington | |
| 2008/0190818 | A1 | 8/2008 | Dana | |
| 2008/0207970 | A1 | 8/2008 | Meurer | |
| 2008/0221226 | A1 | 9/2008 | Coutinho | |
| 2008/0230219 | A1 | 9/2008 | Kaminskey | |
| 2010/0294488 | A1 * | 11/2010 | Wheeler et al. | 166/248 |

FOREIGN PATENT DOCUMENTS

| | | |
|---|---|---|
| DE | 3813014 | 2/1989 |
| GB | 896407 | 5/1962 |
| WO | W09610065 | 4/1996 |
| WO | W02005093210 | 10/2005 |
| WO | W02007084763 | 7/2007 |
| WO | W02007099315 | 9/2007 |

* cited by examiner

*Primary Examiner* — William P Neuder

(74) *Attorney, Agent, or Firm* — ConocoPhillips Company

(57) ABSTRACT

A method for heating heavy oil inside a production well. The method raises the subsurface temperature of heavy oil by utilizing an activator that has been injected below the surface. The activator is then excited with a generated microwave frequency such that the excited activator heats the heavy oil.

30 Claims, 2 Drawing Sheets

IN-SITU UPGRADING OF HEAVY CRUDE OIL IN A PRODUCTION WELL USING RADIO FREQUENCY OR MICROWAVE RADIATION AND A CATALYST

CROSS-REFERENCE TO RELATED APPLICATIONS

None

STATEMENT REGARDING FEDERALLY SPONSORED RESEARCH OR DEVELOPMENT

None

FIELD OF THE INVENTION

The in-situ upgrading of heavy crude oil using radio frequency or microwave radiation and a catalyst.

BACKGROUND OF THE INVENTION

Radio frequencies (RF) have been used in various industries for a number of years. One common use of this type of energy is the household cooking appliance known as the microwave (MW) oven.

Microwave radiation couples with, or is absorbed by, non-symmetrical molecules or those which possess a dipole moment. In cooking applications, microwaves are absorbed by water present in food. Once this occurs, the water molecules rotate and generate heat. The remainder of the food is then heated through a conductive heating process.

Hydrocarbons do not typically couple well with MW radiation. This is due to the fact that these molecules do no possess a dipole moment. However, heavy crude oils are known to possess asphaltenes which are molecules with a range of chemical compositions. Asphaltenes are often characterized as polar, metal containing molecules. These traits make them exceptional candidates for coupling with microwave radiation. By targeting these molecules with MW/RF radiation, localized heat will be generated which will induce a viscosity reduction in the heavy oil. Through the conductive heating of the heavy crude oil or bitumen in place, a potential decrease in the startup time of a steam assisted gravity drainage (SAGD) operation may be experienced. This may also lead to decreases in the amount of water required and green house gas emissions produced which will have positive economic and environmental impacts on operations.

Additionally, the use of MW radiation in the presence of an alternate heat source can decrease the activation energy required for converting and breaking down carbon-carbon bonds. This synergistic effect can lead to the in situ upgrading of heavy crude oils by breaking down molecules which are known to significantly increase the viscosity of the crude oil. However, the use of RF/MW frequencies in a reservoir is not straight forward, nor is the selection of the appropriate RF/MW frequency.

U.S. Pat. No. 4,144,935 attempts to solve this problem by limiting the range in which radio frequencies are used to heat a particular volume in a formation. Such a method decreases the ability for one to use radio frequencies over a broad area and does not eliminate the problem of selecting the appropriate radio frequency to match the multitude of chemical components within the crude oil or bitumen. Furthermore, this method does not teach directing a radio frequency into a production well or bitumen formation to upgrade the heavy oil prior to the refinery process.

By using variable microwave frequency, one can tune the microwave frequency generated within the reservoir to one that interacts best with the dipole moment present within the hydrocarbons. However, previous work has shown that microwave radiation alone is not sufficient to break bonds, but the activation energy associated with breaking bonds is lowered when bonds are rotated in the presence of elevated temperatures.

U.S. Pat. No. 5,055,180 attempts to solve the problem of heating mass amounts of hydrocarbons by generating radio frequencies at differing frequency ranges. However use of varying radio frequencies means that there are radio frequencies generated that are not efficiently utilized. In such a method one would inherently generate radio frequencies that have no effect on the heavy oil or bitumen. Furthermore, this method does not teach directing a radio frequency into a production well to upgrade the heavy oil before transporting to the refinery.

There exists a need for an enhanced process that couples the use of microwave MW/RF radiation to produce an upgraded hydrocarbon within a production well within a bitumen or heavy oil formation.

SUMMARY OF THE INVENTION

A method for heating heavy oil inside a production well. The method raises the subsurface temperature of heavy oil by utilizing an activator that has been injected below the surface. The activator is then excited with a generated microwave frequency such that the excited activator heats the heavy oil.

The method also teaches an alternate embodiment for upgrading heavy oil inside a production well. The method raises the subsurface temperature of heavy oil by utilizing an activator that has been injected below the surface. The activator is then excited with a generated microwave frequency such that the excited activator heats the heavy oil. A catalyst is then injected below the surface such that the catalyst contacts the heated heavy oil thereby producing an upgraded heavy oil.

An apparatus for a SAGD well pair comprising an injection well and a production well, wherein an activator has been injected below the surface and is dispersed throughout the heavy oil and the production well. One or more microwaves transmitting devices are located proximate to the production well which are coupled to a microwave generator. The microwave generator produces a frequency that is transmitted by the microwave transmitters that excites the activator thereby heating the heavy oil in the production well.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Figure 1:
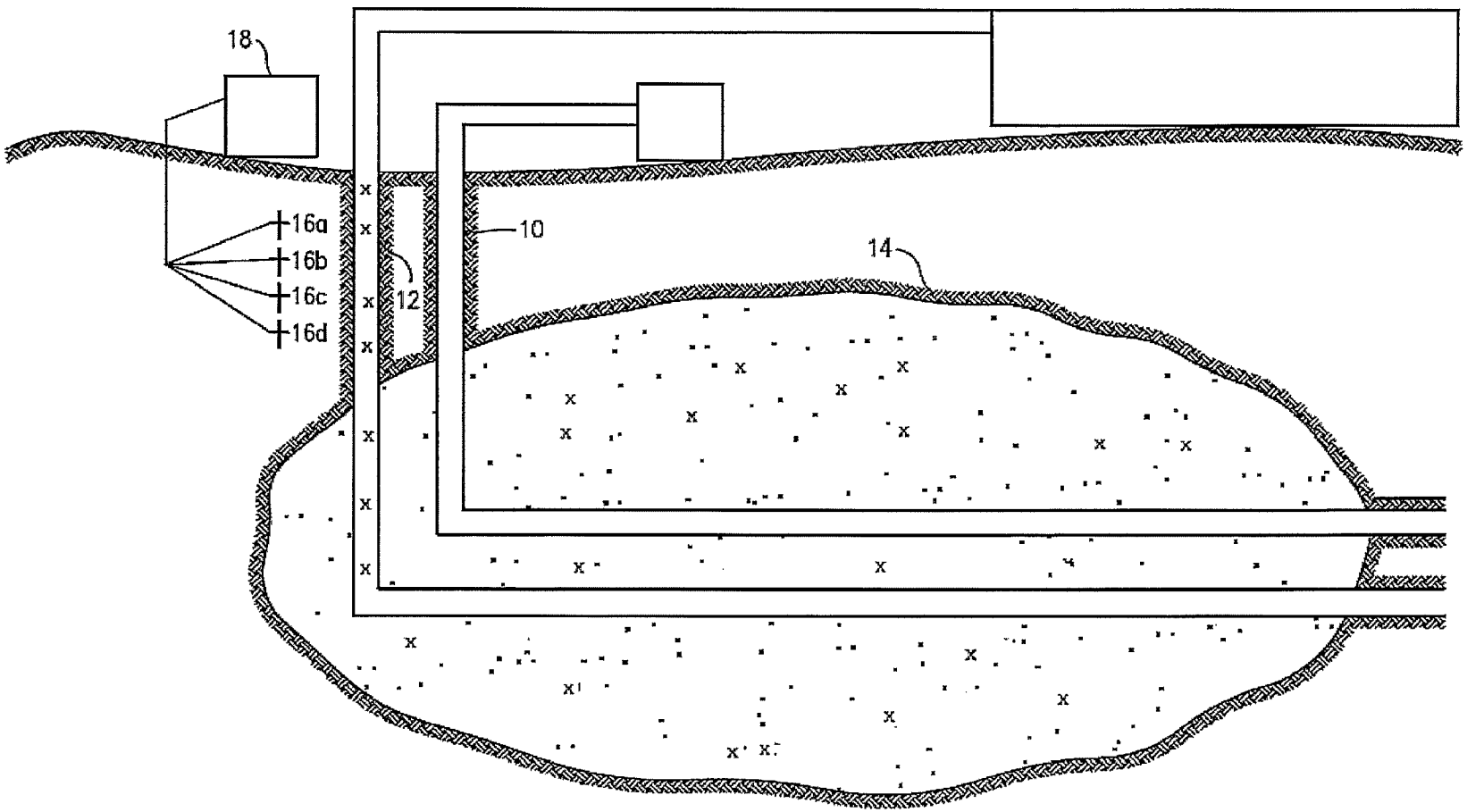
FIG. 1 depicts a method of upgrading heavy oil inside a production well by injecting a catalyst into the production well.

The current method teaches the ability to upgrade heavy oil in a production well. The method first raises the temperature of heavy oil inside a production well of a steam assisted gravity drainage operation. The method also upgrades the heavy oil through the use of a catalyst to hydrogenize or desulfurize the heavy oil, injected into the production well.

During the raising of temperature of the heavy oil inside the production well activators and microwave frequencies are utilized. The temperature of the heavy oil is raised inside the production well by injecting an activator into the production well; directing a microwave frequency into the production well; exciting the activator with a microwave frequency and heating the heavy oil inside the production well with the excited activator.

By choosing specific activators to inject into the production well, one skilled in the art would have the requisite knowledge to select the exact RF/MW frequency required to achieve maximum heating of the activator. Therefore the current method eliminates the need to arbitrarily generate variable microwave frequency which may or may not be able to efficiently absorb the microwave radiation. The activator ionic liquids chosen would have specific properties such as containing positively or negatively charged ions in a fused salt that absorbs MW/RF radiation efficiently with the ability to transfer heat rapidly.

Examples of activators include ionic liquid that may include metal ion salts and may be aqueous. Asymmetrical compounds selected for the microwave energy absorbing substance provide more efficient coupling with the microwaves than symmetrical compounds. In some embodiments, ions forming the microwave energy absorbing substance include divalent or trivalent metal cations. Other examples of activators suitable for this method include inorganic anions such as halides. In one embodiment the activator could be a metal containing compound such as those from period 3 or period 4. In yet another embodiment the activator could be a halide of Na, Al, Fe, Ni, or Zn, including $AlCl_4^-$, $FeCl_4^-$, $NiCl_3^-$, $ZnCl_3^-$ and combinations thereof. Other suitable compositions for the activator include transitional metal compounds or organometallic complexes. The more efficient an ion is at coupling with the MW/RF radiation the faster the temperature rise in the system.

In one embodiment the added activator chosen would not be a substance already prevalent in the crude oil or bitumen. Substances that exhibit dipole motion that are already in the formation include water, salt, asphaltenes and other polar molecules. By injecting an activator not naturally present in the system, it not only permits the operator to establish the exact microwave frequency required to activate the activator but it permits the operator the knowledge of how to eliminate the activator afterwards.

Methods of eliminating the activator include chealation, adsorption, crystallization, distillation, evaporation, flocculation, filtration, precipitation, sieving, sedimentation and other known separation methods. All these methods are enhanced when one skilled in the art are able to ascertain the exact chemical that one is attempting to purge from a solution.

One skilled in the art would also be able to select a specific activator that does not need to be eliminated from the solution. One such example of an activator that can remain in crude oil includes activated carbon or graphite particles In one embodiment a predetermined amount of activators, comprising of metal ion salts, are injected into the production well via a solution. Microwave frequency generators are then operated to generate microwave frequencies capable of causing maximum excitation of the activators. For some embodiments, the microwave frequency generator defines a variable frequency source of a preselected bandwidth sweeping around a central frequency. As opposed to a fixed frequency source, the sweeping by the microwave frequency generator can provide time-averaged uniform heating of the hydrocarbons with proper adjustment of frequency sweep rate and sweep range to encompass absorption frequencies of constituents, such as water and the microwave energy absorbing substance, within the mixture. The microwave frequency generator may produce microwaves or radio waves that have frequencies ranging from 0.3 gigahertz (GHz) to 100 GHz. For example, the microwave frequency generator may introduce microwaves with power peaks at a first discrete energy band around 2.45 GHz associated with water and a second discrete energy band spaced from the first discrete energy band and associated with the activator. Optionally, microwave frequency generators can be utilized to excite pre-existing substances in the aqueous formation that contain existing dipole moments. Examples of these pre-existing substances include: water or salt water used in SAGD operations, asphaltene, heteroatoms and metals.

In an alternate embodiment multiple activators with differing peak excitation levels can be dispersed into the production well. In such an embodiment one skilled in the art would be capable of selecting the preferred range of radio frequencies to direct into the activators to achieve the desired temperature range.

In one embodiment the activators provide all the heat necessary to upgrade the oil in the production well. In an alternate embodiment it is also possible that the activator supplements preexisting heating methods in the production well. In yet another embodiment the heat generated by the activators will be sufficient to produce upgrading of the heavy oil in-situ in the production well. In this instance the upgrading of the heavy oil will supplement the upgrading provided by the catalyst.

For example three different activators with three distinct radio frequencies are injected along the vertical length of the production well. With three different activators the amount of rotational mechanism achieved through each would vary, therefore the temperature in the production well would be different dependant upon the specific activator activated. One skilled in the art would be capable of generating a specific ideal temperature range in the production well by selectively operating the radio frequency generators to activate the appropriate activators to obtain desired temperature range.

The activators can be injected into the production well through a variety of methods as commonly known in the art. Examples of typical methods known in the art include injecting the activators via aqueous solution.

The activators are able to heat the heavy oil/bitumen via conductive and convective mechanisms by the heat generation of the activators. The amount of heat generated could break the large molecules in the heavy oil/bitumen into smaller molecules and hence decrease the viscosity permanently.

RF/MW frequencies come from frequency generators that can be situated either above or below ground. The radio antennas should be directed towards the activators and can be placed either above ground, below ground or a combination of the two. It is the skill of the operator to determine the optimal placement of the radio antenna to target a particular activator to achieve dipole moment vibration while still maintaining ease of placement of the antennas.

In yet another embodiment the oil to be upgraded inside the production well is obtained from an enhanced steam assisted gravity drainage method similar to patent application Ser. No. 61/180,020 hereby incorporated by reference. In such a method since a preexisting activator is already present it eliminates the need to inject additional activators. A radio frequency antenna is directed into the production well, the activator is excited with radio frequencies which is followed by upgrading the oil inside the production well with the excited activator.

The addition of the catalyst aids in the upgrading of the heavy oil. In one embodiment the catalyst is injected into the production well. In another embodiment the catalyst is injected into the production well and the formation. In yet another embodiment the catalyst is injected only into the formation. In each of these embodiments the placement of the catalyst will induce the upgrading in the vicinity of the injection area and continue upgrading as the catalyst moves along the steam assisted gravity drainage operation. The injection of the catalyst can occur through any known injection method in the art.

The catalyst is used to either hydrogenate or desulfurize the heavy oil. Any known catalyst in the art capable of hydrogenating or desulfurizing the heavy oil to induce upgrading can be utilized. In one embodiment the catalyst injected into the production well, the formation or both the production well and the formation is typically a liquid catalyst that is either oil soluble or water soluble. It is preferred that the catalyst is an organometallic complex. The organometallic complex can comprise either one or a combination of a group 6, 7, 8, 9 or 10 metal from the periodic table. More preferably the metal complex comprises nickel, manganese, molybdenum, tungsten, iron or cobalt. In yet another embodiment it is preferred that the catalyst is a peroxide, one example of such a peroxide is hydrogen peroxide.

Other embodiments of hydrogenation catalysts include active metals that specifically have a phosphorus chemical shift value in $^{31}$P-CPMAS-NMR, the peak of which is in the range of preferably 0 to −20 ppm, more preferably −5 to −15 ppm, and even more preferably −9 to −11 ppm. Other embodiments of desulfurization catalysts include those that have hydrogenation functionality.

In a non-limiting embodiment, FIG. 1 depicts a method of utilizing activators in a SAGD system to heat the heavy oil. Normally, the activator can be injected into the production well using any method typically known in the art. In this embodiment the activator is placed downhole either via the steam injection well 10 or the production well 12. In this embodiment the activator is depicted with the symbol "x". Once the activators are in the stratum 14, radio antenna 16*a*, 16*b*, 16*c* and 16*d*, which are attached to a radio frequency generator 18, are used to heat the activators in the production well 12. In other embodiments two or more radio frequencies are generated such that one range excites the activator and the other range excites the existing constituents of the heavy oil.

Figure 2:
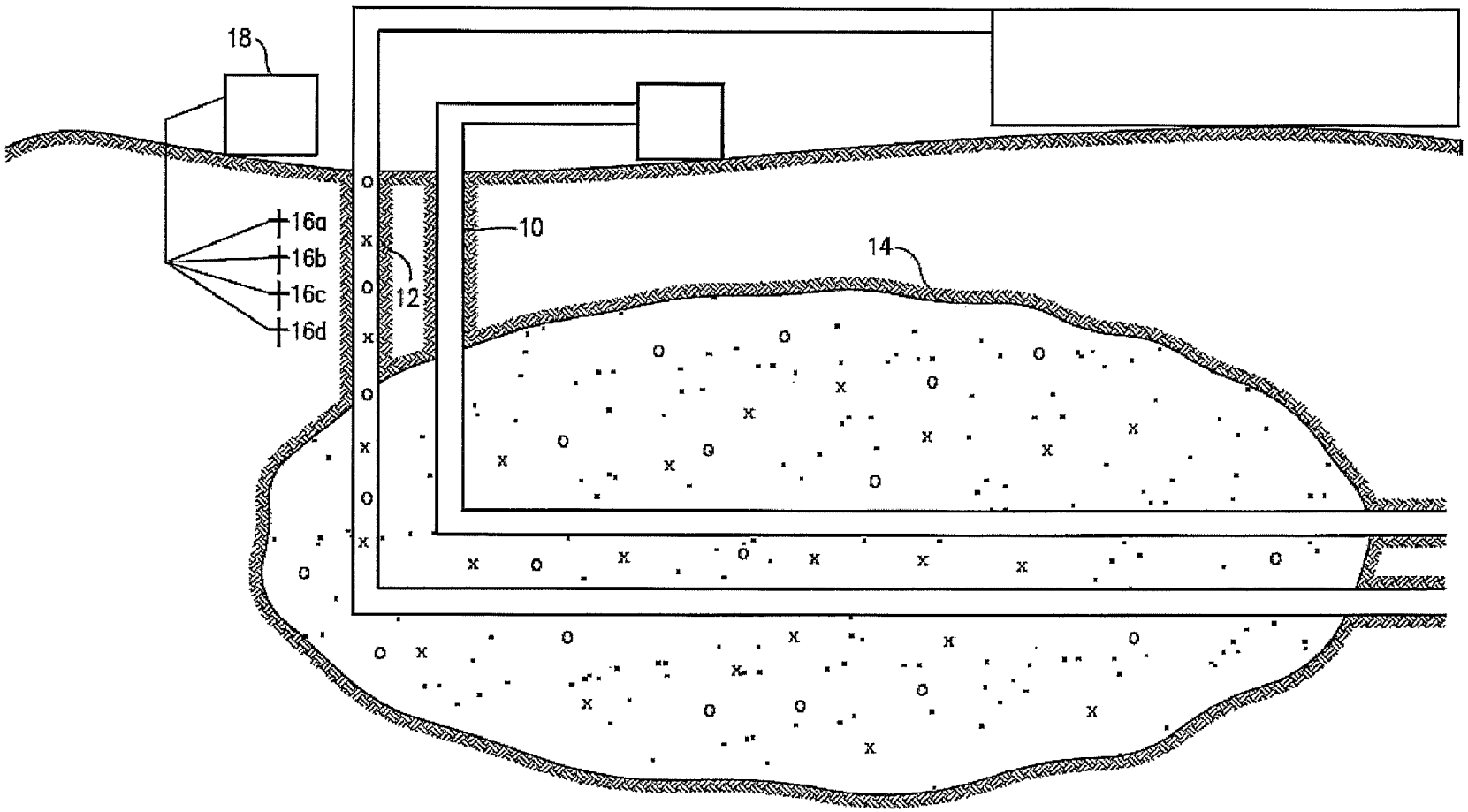
FIG. 2 depicts a method of upgrading heavy oil inside a production well by injecting a catalyst into the formation.

In yet another non-limiting embodiment, FIG. 2 depicts a method of utilizing a method of heating activators in a SAGD system while upgrading the heavy oil with a catalyst. The catalyst can be injected into the formation using any method typically known in the art. In this embodiment the catalyst is depicted with the symbol "o". In this embodiment the activator is placed downhole either via the steam injection well 10 or the production well 12. In this embodiment the activator is depicted with the symbol "x". Once the activators are in the stratum 14, radio antenna 16*a*, 16*b*, 16*c* and 16*d*, which are attached to a radio frequency generator 18, are used to heat the activators in the production well 12.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising:

raising a subsurface temperature of a heavy oil utilizing an activator that has been injected below a surface, and exciting the activator with a generated microwave frequency or radio frequency such that the excited activator heats the heavy oil.

2. The method of claim 1, wherein the microwave frequency and/or radio frequency is regulated to a range necessary to excite the activator.

3. The method of claim 1, wherein two or more microwave frequencies or radio frequency are generated such that one range of the two or more microwave frequencies or radio frequency excites the activator and another of the two or more microwave frequencies or radio frequency excites existing constituents of the heavy oil.

4. The method of claim 1, wherein the activator is injected into a production well.

5. The method of claim 1, wherein the activator is injected into a formation containing the heavy oil and the activator is excited in-situ or inside of a production well.

6. The method of claim 1, wherein the activator is a halide compound.

7. The method of claim 1, wherein the activator is a metal containing compound.

8. The method of claim 6, wherein the halide compound comprises a metal wherein the metal is scandium, yttrium, titanium, zirconium, or hafnium.

9. The method of claim 1, wherein the activator comprises at least one of $AlCl_4^-$, $FeCl_4^-$, $NiCl_3^-$ and $ZnCl_3^-$.

10. A method comprising:

raising a subsurface temperature of a heavy oil utilizing an activator that has been injected below a surface, and exciting the activator with a generated microwave frequency or radio frequency such that the excited activator heats the heavy oil, and injecting a catalyst below the surface such that the catalyst contacts the heated heavy oil so as to produce an upgraded heavy oil.

11. The method of claim 10, wherein the catalyst is a hydrogenation catalyst, a desulfurization catalyst or combination.

12. The method of claim 10, wherein the heavy oil is comprised of a plurality of molecules, wherein the upgrading of the heavy oil causes some of the molecules of the heavy oil to be converted into smaller molecules.

13. The method of claim 10, wherein the catalyst is a liquid catalyst.

14. The method of claim 10, wherein the catalyst is an organometallic complex.

15. The method of claim 10, wherein the organometallic complex comprises a metal wherein the metal is chromium, molybdenum, tungsten, manganese, rhenium, iron, ruthenium, osmium, cobalt, rhodium, iridium, nickel, palladium, or platinum.

16. The method of claim 10, wherein the catalyst is a peroxide.

17. The method of claim 10, wherein the catalyst is injected into a production well.

18. The method of claim 10, wherein the catalyst is injected into a formation.

19. An apparatus comprising:

a steam assisted gravity drainage well pair comprising an injection well and a production well, wherein an activator has been injected below a surface and is dispersed throughout a heavy oil and a production well; one or more microwave or radio frequency transmitting devices located proximate to the production well; and a microwave or radio frequency generator coupled to the one or more microwave or radio frequency transmitters, wherein the microwave or radio generator produces a frequency that is transmitted by the microwave or radio frequency transmitters that excites the activator so as to heat the heavy oil in the production well.

20. The apparatus of claim 19, wherein two or more microwave or radio frequencies are generated such that one range of the two or more microwave or radio frequencies excites the activator and another of two or more microwave or radio frequencies excites existing constituents of the heavy oil.

21. The apparatus of claim 19, wherein the activator is a halide compound.

22. The apparatus of claim 19, wherein the activator is a metal containing compound.

23. The apparatus of claim 21, wherein the halide compound comprises a metal wherein the metal is scandium, yttrium, titanium, zirconium, or hafnium.

24. The apparatus of claim 19, wherein the activator comprises at least one of $AlCl_4^-$, $FeCl_4^-$, $NiCl_3^-$ and $ZnCl_3^-$.

25. The apparatus of claim 19, wherein the heated heavy oil is further upgraded by injecting a catalyst below the surface such that the catalyst contacts the heated heavy oil so as to produce an upgraded heavy oil.

26. The apparatus of claim 25, wherein the catalyst is a hydrogenation catalyst, a desulfurization catalyst or combination.

27. The apparatus of claim 25, wherein the catalyst is an organometallic complex.

28. The apparatus of claim 25, wherein the organometallic complex comprises a metal wherein the metal is chromium, molybdenum, tungsten, manganese, rhenium, iron, ruthenium, osmium, cobalt, rhodium, iridium, nickel, palladium, or platinum.

29. The apparatus of claim 25, wherein the catalyst is a peroxide.

30. The apparatus of claim 25, wherein the upgrading of the heavy oil causes some of the molecules of the heavy oil to be converted into smaller molecules.

* * * * *